US007976441B2

(12) United States Patent
Ellis

(10) Patent No.: US 7,976,441 B2
(45) Date of Patent: Jul. 12, 2011

(54) MOMENT ARM WEIGHT RESISTANCE MECHANISM AND WEIGHT TRAINING MACHINES UTILIZING THE SAME

(75) Inventor: Joseph K. Ellis, Ocla, FL (US)

(73) Assignee: Fitness Tools LLC, Ocala, FL (US)

( * ) Notice: Subject to any disclaimer, the term of this patent is extended or adjusted under 35 U.S.C. 154(b) by 0 days.

(21) Appl. No.: 11/828,454

(22) Filed: Jul. 26, 2007

(65) Prior Publication Data

US 2009/0029835 A1 Jan. 29, 2009

(51) Int. Cl.
*A63B 21/00* (2006.01)

(52) U.S. Cl. ..... 482/96; 76/114; 76/97; 76/130

(58) Field of Classification Search ..... 482/96, 482/97, 100, 5, 130; 76/114
See application file for complete search history.

(56) References Cited

U.S. PATENT DOCUMENTS

| | | | | | |
|---|---|---|---|---|---|
| 684,488 | A * | 10/1901 | Herz | 76/114 |
| 3,588,101 | A * | 6/1971 | Jungreis | 482/5 |
| 4,407,495 | A * | 10/1983 | Wilson | 482/97 |
| 4,502,681 | A * | 3/1985 | Blomqvist | 482/130 |
| 4,863,161 | A * | 9/1989 | Telle | 482/97 |
| 7,278,958 | B2 * | 10/2007 | Morgan | 482/97 |

* cited by examiner

*Primary Examiner* — Jerome W Donnelly
(74) *Attorney, Agent, or Firm* — Laurence P. Colton; Smith Risley Tempel Santos LLC

(57) ABSTRACT

A weight training machine having a moment arm weight resistance means for creating a weight resistance or weight load.

4 Claims, 7 Drawing Sheets

Fig. 11
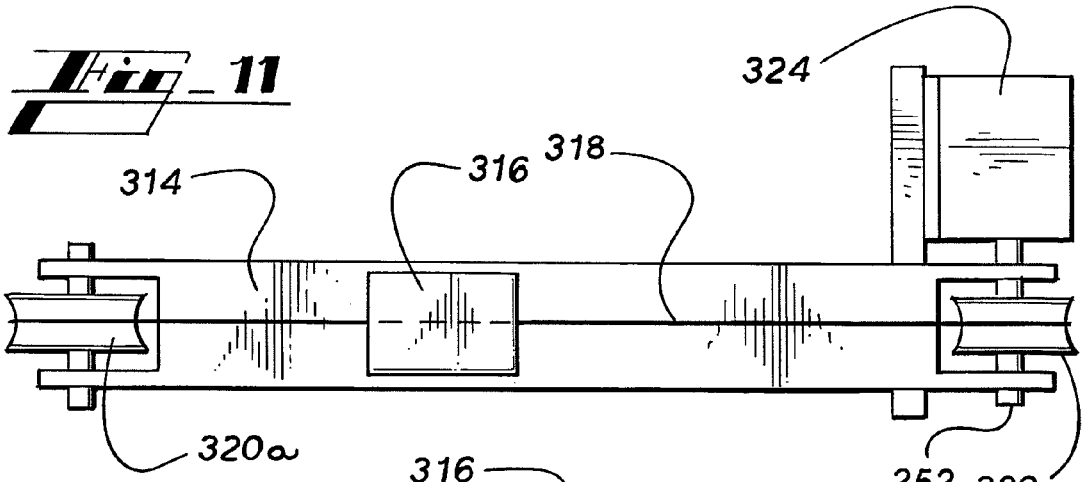
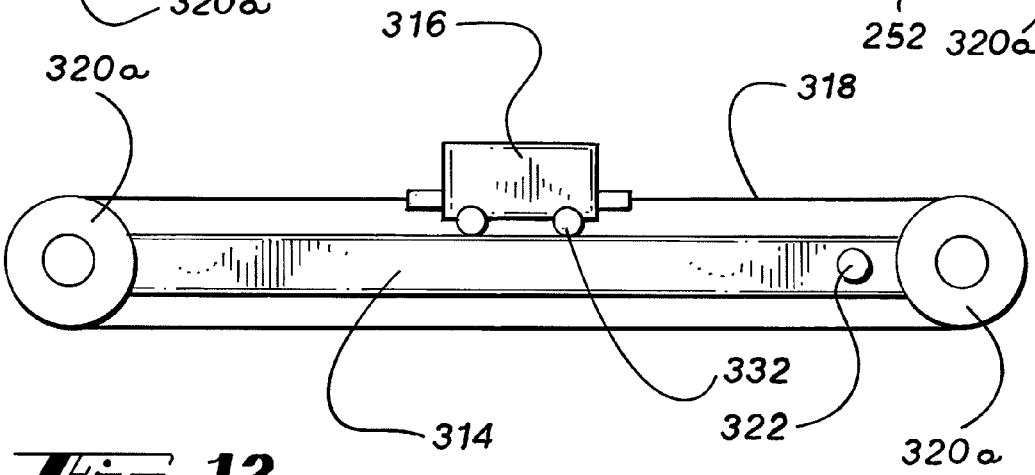
Fig. 12
Fig. 13
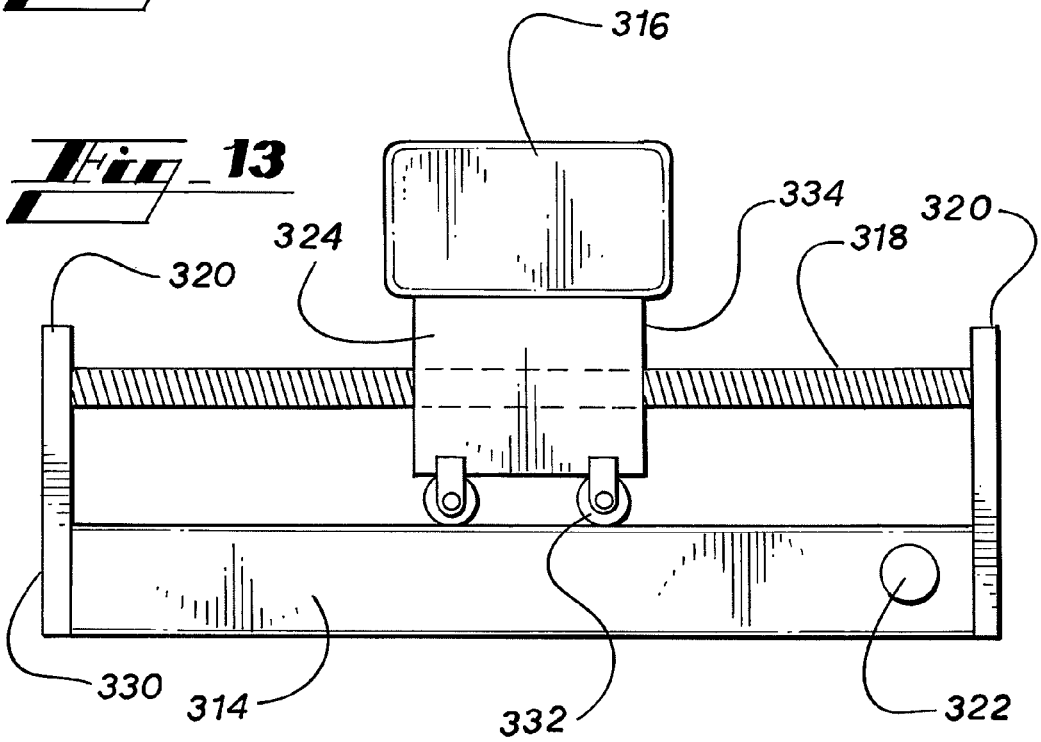

MOMENT ARM WEIGHT RESISTANCE MECHANISM AND WEIGHT TRAINING MACHINES UTILIZING THE SAME

BACKGROUND OF THE INVENTION

1. Technical Field

This invention relates to the general technical field of exercise, physical fitness and physical therapy equipment and machines and to the more specific technical field of a moment arm weight resistance mechanism to generate weight resistance for such weight training equipment and machines.

2. Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on areas of the body such as the legs, the hips and lower torso, the chest and upper torso, the back, the shoulders and the arms.

Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

There are physical fitness and physical therapy equipment and machine having alternative weight resistance devices. One example is disclosed in U.S. Patent Publication No. 20060105889 to Webb and assigned to Nautilus, Inc., which discloses an exercise machine having a rotatable weight selection index that is rotated to operably couple the exercise member to at least one weight plate such that the displacement of the exercise member causes the displacement of the weight plate. This device has a plurality of weight plates and the index allows the selection of different combinations of weight plates for operable coupling to the exercise member. Other exampled are the BOWFLEX® brand line of products offered by Nautilus, Inc., which incorporate flexible rods and spiral devices to produce a weight resistance.

U.S. Pat. No. 4,257,593 to Keiser discloses a pneumatic exercising device including a source of gas and a pneumatic resisting mechanism connected to the source of gas and operable to compress gas received from the source to provide a resistance to movement. In other words, this device uses a pneumatic weight resistance mechanism.

Other alternative weight resistance mechanisms include hydraulic cylinders and electromagnetic devices. Several examples of such mechanisms are shown on a brochure put out by the American College of Sports Medicine entitled Selectively and Effectively Using Home Weights.

This inventor previously has developed a composite motion movement machine for use in connection with exercise and physical therapy equipment. U.S. Pat. No. 6,264,588 discloses this composite motion movement machine, which combines a moving actuating member and a moving user support, the composite motion movement machine having a support member, a frame on which the user support is located, the frame being pivotally connected to the support member, a truck in slidable engagement with the support member and the frame, an actuating member being pivotally connected to the support member and operatively connected to the truck, the actuating member being adapted to move between a first position and a second position, and a linking mechanism operatively connecting said actuating member with said truck, wherein, when the user moves the actuating member between the first position and the second position, the truck moves along rails on the support member, forcing the frame to pivot relative to the support member and causing the user to actuate a resistance weight, thus exercising, strengthening or rehabilitating certain of the user's muscles. This machine can be used in connection with a variety of different weight resistance means, such as stack weights, free weights, and alternative weight resistance devices.

U.S. Pat. No. 6,287,241 discloses this inventor's improvement on leg press exercise apparatuses by utilizing composite motion movement combined with a moving actuating member and a moving user support, the leg press having a support member, a frame on which the user support is located, the frame being pivotally connected to the support member, a truck in slidable engagement with the support member and the frame, an actuating member on which a push plate is located, the actuating member being pivotally connected to the support member and operatively connected to the truck, the actuating member being adapted to move between a first position and a second position, and a linking mechanism operatively connecting the actuating member the truck, wherein, when the user pushes the actuating member between the first position and the second position, the truck moves along rails on the support member, forcing the frame to pivot relative to the support member and causing the user to actuate a resistance weight, thus exercising certain of the user's muscles. This machine can be used in connection with a variety of different weight resistance means, such as stack weights, free weights, and alternative weight resistance devices.

There are many other examples of leg exercise machines. U.S. Pat. No. 4,149,714 to Lambert, Jr. discloses a seated weight lifting leg press exercise machine having a moving push plate and a stationary seat. U.S. Pat. No. 4,828,254 to Maag discloses a crank and slider/four-bar variable resistance carriage-type leg press machine having a stationary push plate and a moving seat. U.S. Pat. No. 5,106,080 to Jones discloses a leg press exercise machine having a stationary seat and two moving push plates, one for each leg. U.S. Pat. No. 5,366,432 to Habing et al. discloses a leg press having a stationary seat and a moving push plate. U.S. Pat. No. 5,484,365 to Jones et al. discloses a leg press exercise machine having a stationary seat and a moving push plate. U.S. Pat. No. 5,554,086 to Habing et al. discloses a leg press exercise apparatus having a stationary push plate and a moving seat. U.S. Pat. No. 5,554,090 to Jones discloses a calf exercise machine having a stationary seat and a moving push plate. U.S. Pat. No. 5,616,107 to Simonson discloses a method and apparatus for leg press exercise with counterbalance having a stationary seat and a moving push plate. U.S. Pat. No. 5,795,270 to Woods et al. discloses a semi-recumbent arm and leg press and aerobic exercise apparatus having a stationary seat and a moving push plate.

There are many examples of chest exercise machines. U.S. Pat. No. 5,554,089 to Jones discloses a military press exercise machine having a stationary seat and moving actuating grips. U.S. Pat. No. 5,643,152 to Simonson discloses a chest press exercise machine and method of exercising having a stationary seat and moving actuator grips. U.S. Pat. No. 5,997,447 to Giannelli et al. discloses a chest press apparatus for exercising regions of the upper body having a stationary seat and moving actuator grips.

There are many examples of back exercise machines. U.S. Pat. No. 5,135,449 to Jones discloses a rowing exercise machine having a stationary seat and moving actuating grips. U.S. Pat. No. 5,620,402 to Simonson discloses a rear deltoid and rowing exercise machine and method of exercising having a stationary seat and moving actuator grips.

There are other machines for exercising other parts of the torso, such as the abdominal muscles, or combinations of muscles. U.S. Pat. No. 5,125,881 to Jones discloses a rear shoulder exercise machine having a stationary bench and moving actuating pads. U.S. Pat. No. 5,554,084 to Jones discloses an abdominal/hip flex exercise machine having a stationary seat and moving actuator pads. U.S. Pat. No. 6,010,437 to Jones discloses a standing push/pull exercise machine having no user support and moving actuator grips.

The previously described art comprises a general cross-section of the exercise and physical therapy equipment and machine art as it is today. As can be seen, individual apparatuses either use weight plates, weight stacks, free weights, user body weight, tensile resistance, or air resistance, or a combination of weight stacks or free weights with the user's body weight. Thus it can be seen that a moment arm weight resistance mechanism and a weight training machine comprising a moment arm weight resistance mechanism would be useful, novel and not obvious, and a significant improvement over the prior art. Such a mechanism can be used as the basic operative mechanism on a wide variety of weight training equipment and machines. It is to such a moment arm weight resistance mechanism and weight training equipment and machines that the current invention is directed.

BRIEF SUMMARY OF THE INVENTION

Briefly, the invention is a moment arm weight resistance mechanism to generate weight resistance for weight training equipment and machines. The invention comprises a cam, a moment arm, an adjustable weight, a weight adjusting drive, a pivot point about which the moment arm pivots, and a weight adjusting motor for moving the weight along the moment arm. The moment arm is pivotally secured about the pivot point, about which the moment is created, and extends generally normal to the pivot axis of the pivot point. Thus, the moment arm acts as a cantilever extending from the pivot point, and the moment arm can rotate about the pivot axis of the pivot point. The moment creates a weight resistance that can be utilized in weight training machines as an alternative.

In one embodiment, the moment arm is a generally hollow, elongated, box-like structure containing the weight and the weight adjusting drive. The weight adjusting motor also can be within the moment arm, but also can be located outside of the box-like structure with the weight adjusting drive extending from the weight adjusting motor through a hole in an end of, and into the interior of, the box-like structure of the moment arm. The moment arm can be secured to the moment arm pivot rod by any known or suitable means. The pivot rod is an attachment means for pivotally and operatively attaching the moment arm to a weight training machine. The weight adjusting drive cooperates with the weight such that when the weight adjusting drive is activated, the weight will move relatively along the weight adjusting drive and the moment arm, thus adjusting the level of weight resistance.

The moment arm weight resistance mechanism can be pivotally attached to the weight training machine such that when activated, the moment arm can pivot or swing upwards and downwards without any or undue hindrance by any components of the weight training machine. The pivot rod can be pivotally mounted on the frame of the weight training machine. A cable can be attached to an actuating device, such as a hand grip or leg pad, and can travel through or about the frame via pulleys, ultimately to the moment arm weight resistance mechanism. The user sits on the weight training machine in the known manner, with the user's hand or legs contacting the actuating means. When the user actuates the actuating device or means, such as by pulling down on a hand grip or bar, by moving a hand bar or leg bar, or by using his or her legs to move a leg pad, the cable is pulled with the ultimate result of pulling upwards on a cam, thus rotating the cam. As the cam is attached to the moment arm, the moment arm also is rotated upwards, causing the moment about the pivot point and the weight resistance against the cable. By moving the actuating device or means, the user causes the upward and downward rotation of the moment arm, and obtains a weight resistance workout.

The degree of weight resistance of the weight resistance means can be controlled by the user. As the adjustable weight is adjusted along the moment arm relative to a pivot point of the moment arm, the weight resistance of the moment arm is increased or decreased.

These features, and other features and advantages of the present invention will become more apparent to those of ordinary skill in the art when the following detailed description of the preferred embodiments is read in conjunction with the appended figures in which like reference numerals designate like elements throughout the several views.

BRIEF DESCRIPTION OF THE DRAWINGS

FIG. 11 is a top view of an alternate embodiment of the moment arm weight resistance mechanism of the invention.

FIG. 12 is a side view of the alternate embodiment of the moment arm weight resistance mechanism shown in FIG. 11.

FIG. 13 is a side view of another alternate embodiment of the moment arm weight resistance mechanism of the invention.

DETAILED DESCRIPTION OF THE PREFERRED EMBODIMENTS

Referring now to the appended figures, the invention will be described in connection with representative preferred embodiments. Throughout this specification, various terms will be used to describe various elements or sets of elements, features or sets of features, and devices or sets of devices. For example, the term weight training machine will be used to describe any weight training machine in which a user pulls, pushes, squeezes, twists, or otherwise moves or manipulates an actuating means or device to activate weight resistance. The term actuating means or actuating device will be used to describe any bar, handle, pad, or other element that is operatively connected to the moment arm weight resistance mechanism. The term at rest and resting mode will be used to describe when the user is not engaging the moment arm weight resistance mechanism, or only minimally so. The term operating and operating mode will be used to describe when the user is engaging the moment arm weight resistance mechanism. The term pull, when referring to the user operating the actuating means or device, will be used to describe any motion or movement by a user on the actuating means or device to activate weight resistance, including but not limited to pulling, pushing, squeezing, twisting, and rotating.

Figure 1:
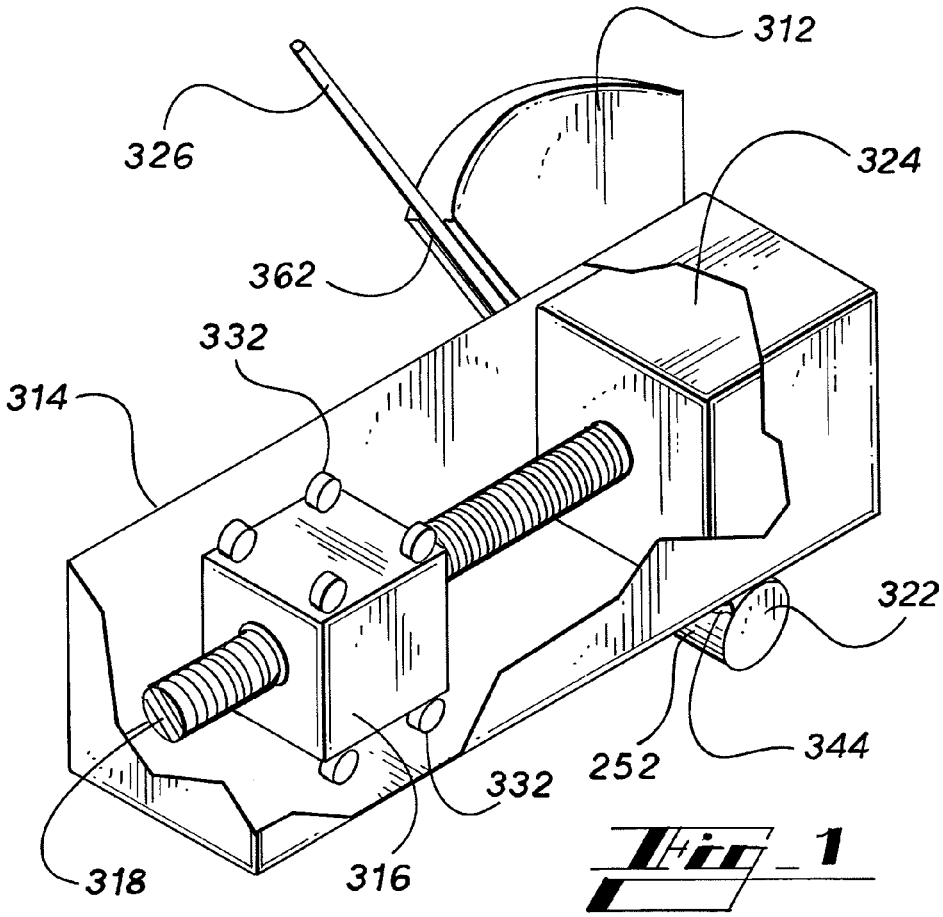
FIG. 1 is a sectional perspective view of an embodiment of the moment arm weight resistance mechanism of the invention.
Figure 2:
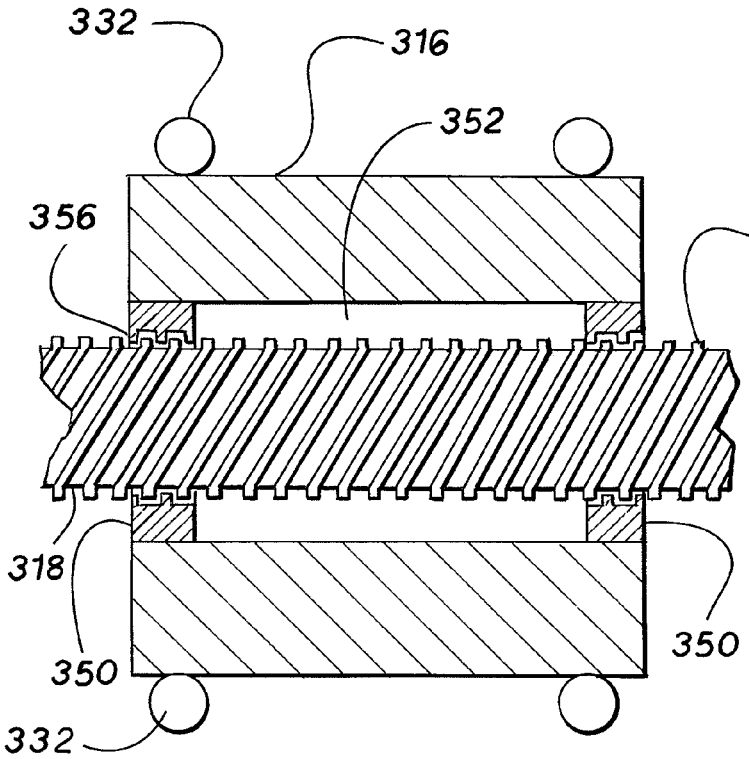
FIG. 2 is a sectional side view of a weight and weight adjusting drive that can be used with the invention.

FIG. 1 is a sectional perspective view of an embodiment of the moment arm weight resistance mechanism of the invention showing basic working elements of the invention in a closed box configuration. FIG. 2 is a sectional side view of a weight and weight adjusting drive that can be used with the invention, corresponding with the weight and weight adjusting drive shown in FIG. 1.

Figure 3:
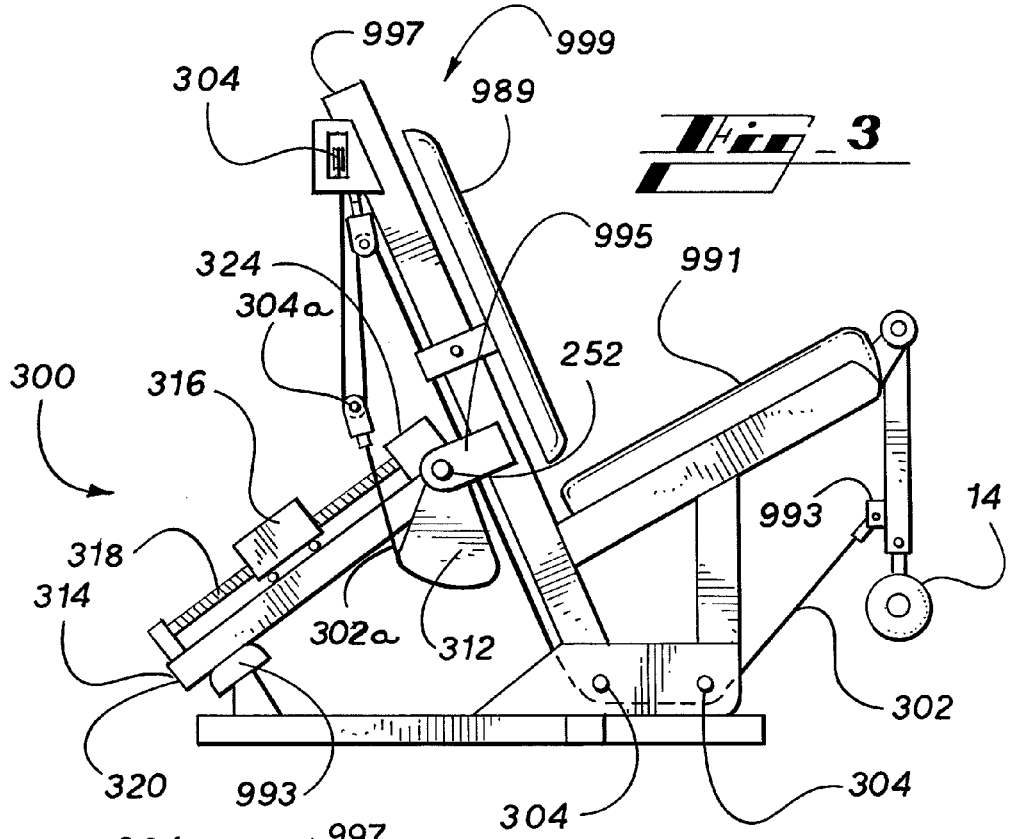
FIG. 3 is a side view of a single function weight training machine comprising an embodiment of the moment arm weight resistance mechanism of the present invention in the resting mode.
Figure 4:
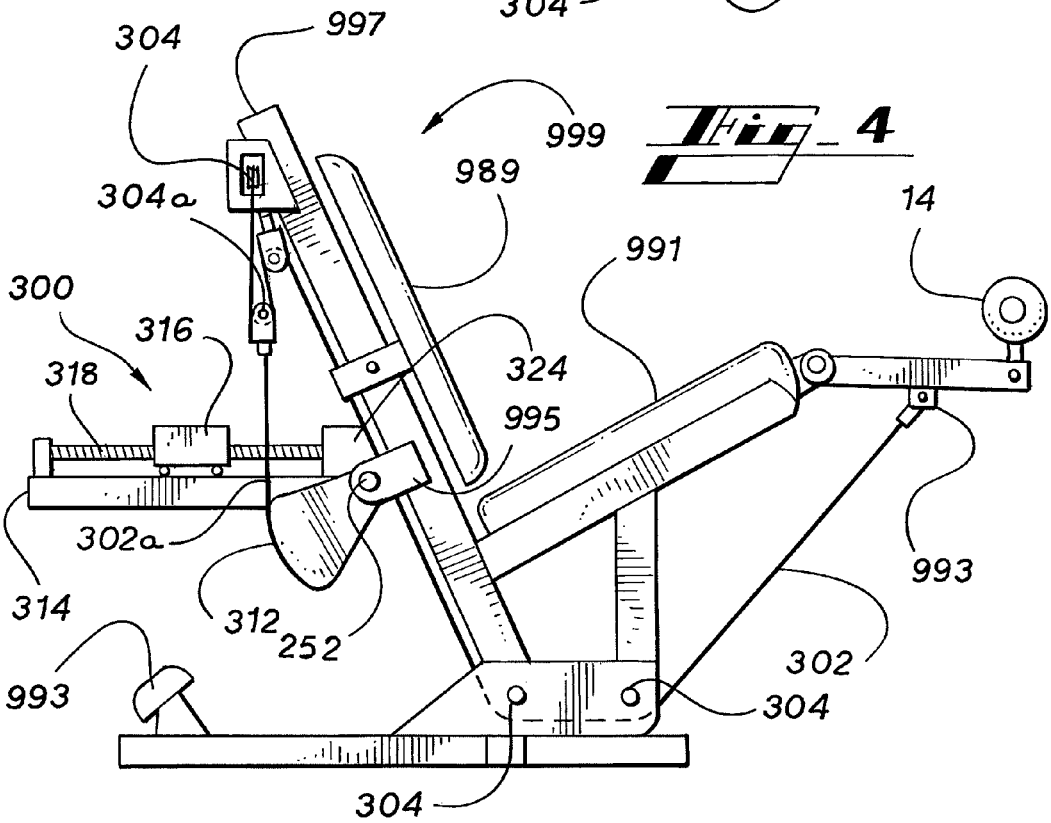
FIG. 4 is a side view of the weight training machine shown in FIG. 3 comprising an embodiment of the moment arm weight resistance mechanism of the present invention in the operating mode.
Figure 5:
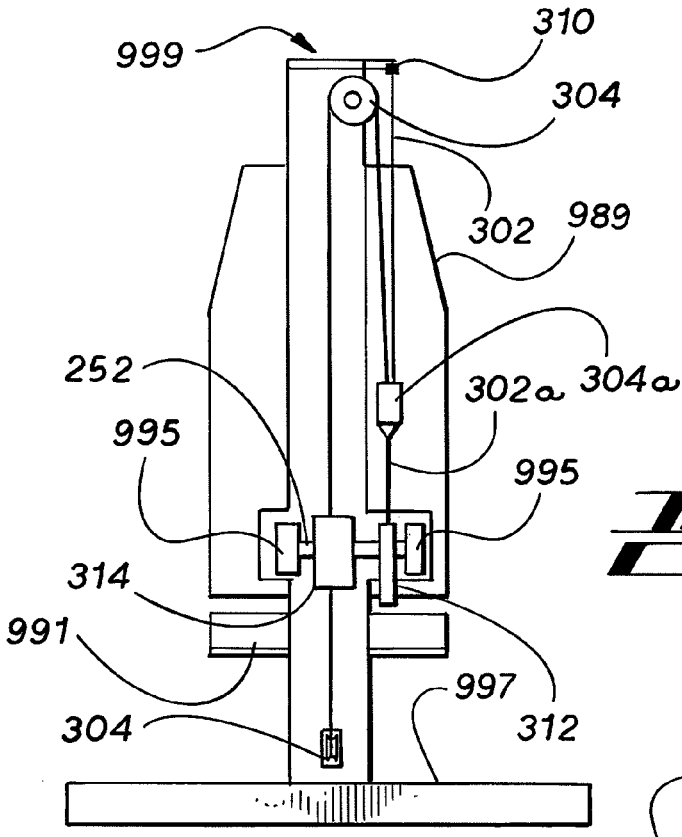
FIG. 5 is a rear view of the weight training machine shown in FIG. 3 comprising an embodiment of the moment arm weight resistance mechanism of the present invention.

FIG. 3 is a side view of a first representative weight training machine comprising an embodiment of the moment arm weight resistance mechanism of the present invention in the resting mode, that is, with the user at rest. This weight training machine is a leg extension quadriceps machine. FIG. 4 is a side view of the weight training machine shown in FIG. 3 comprising an embodiment of the moment arm weight resistance mechanism of the present invention in the operating mode, that is, with the user lifting weight. FIG. 5 is a rear view of the weight training machine shown in FIG. 3 comprising an embodiment of the moment arm weight resistance mechanism of the present invention.

Figure 6:
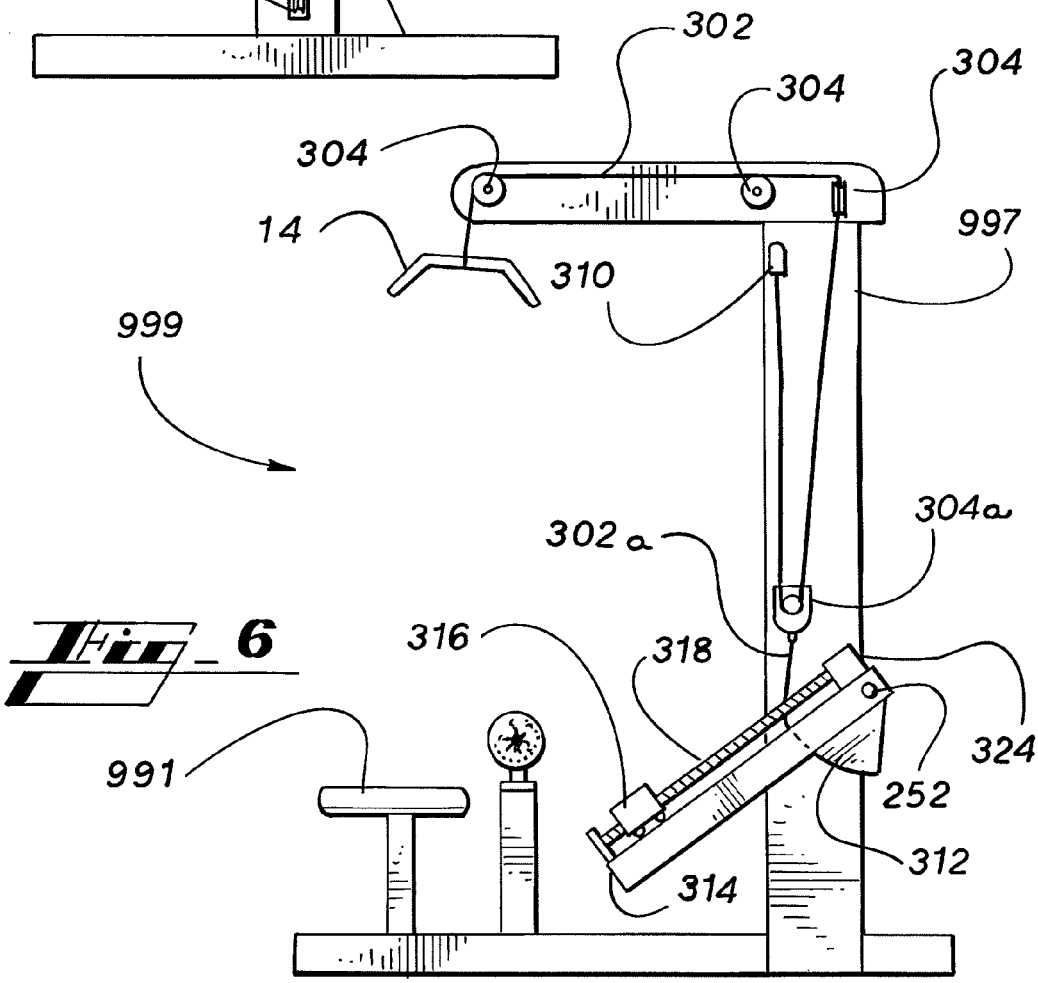
FIG. 6 is a side view of a single function weight training machine comprising an embodiment of the moment arm weight resistance mechanism of the present invention in the resting mode.
Figure 7:
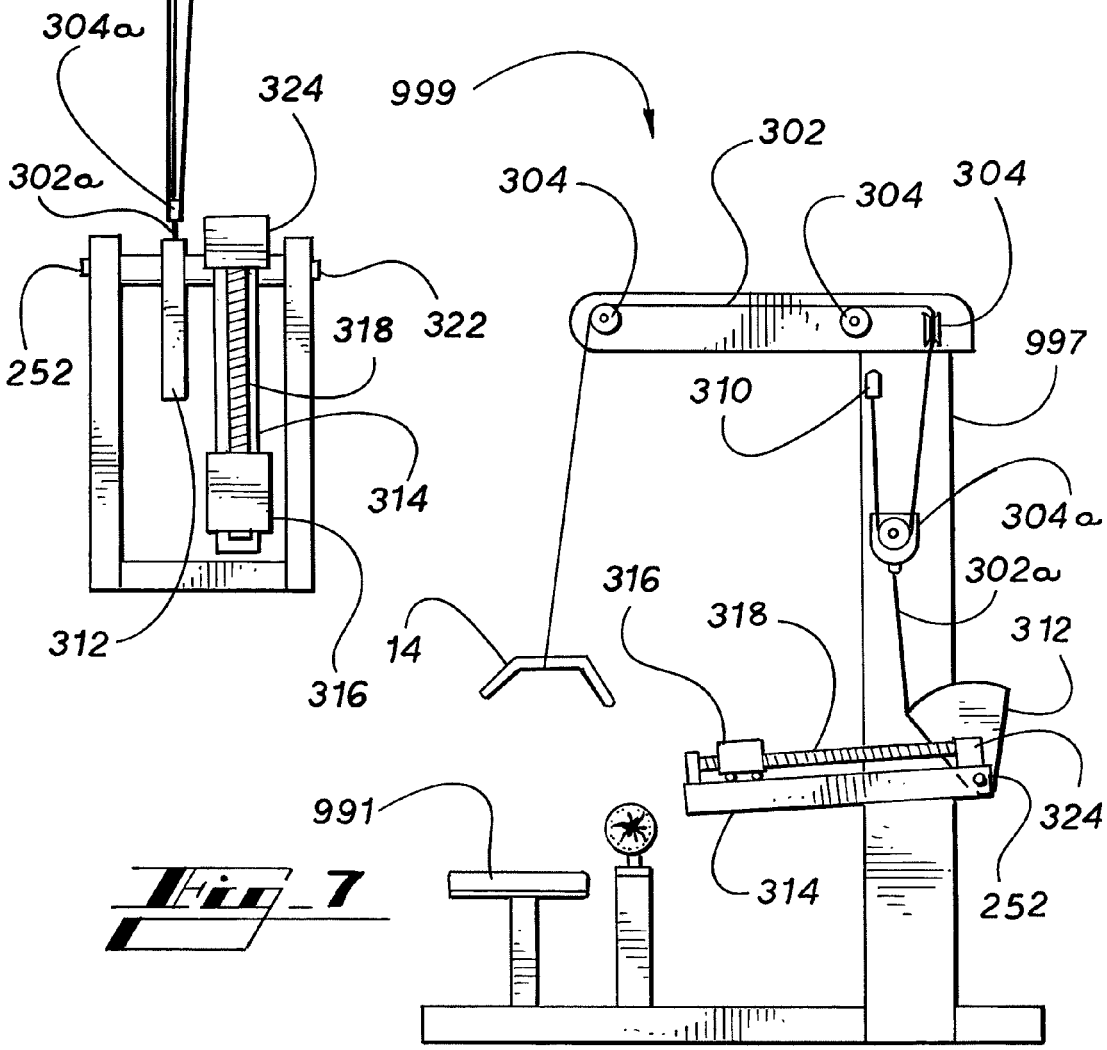
FIG. 7 is a side view of a weight training machine shown in FIG. 6 comprising an embodiment of the moment arm weight resistance mechanism of the present invention in the operating mode.

FIG. 6 is a side view of a second representative weight training machine comprising an embodiment of the moment arm weight resistance mechanism of the present invention in the resting mode, that is, with the user at rest. This machine is a latissimus dorsi pull-down machine. FIG. 7 is a side view of the weight training machine shown in FIG. 6 comprising an embodiment of the moment arm weight resistance mechanism of the present invention in the operating mode, that is, with the user lifting weight.

Figure 10:
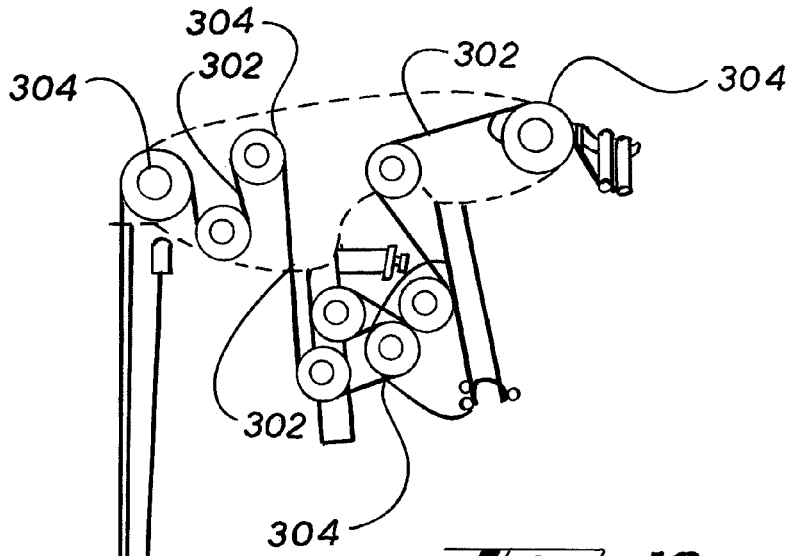
FIG. 10 is a side view of an embodiment of a cable and pulley configuration for a weight training machine comprising an embodiment of the moment arm weight resistance mechanism of the present invention.
Figure 8:
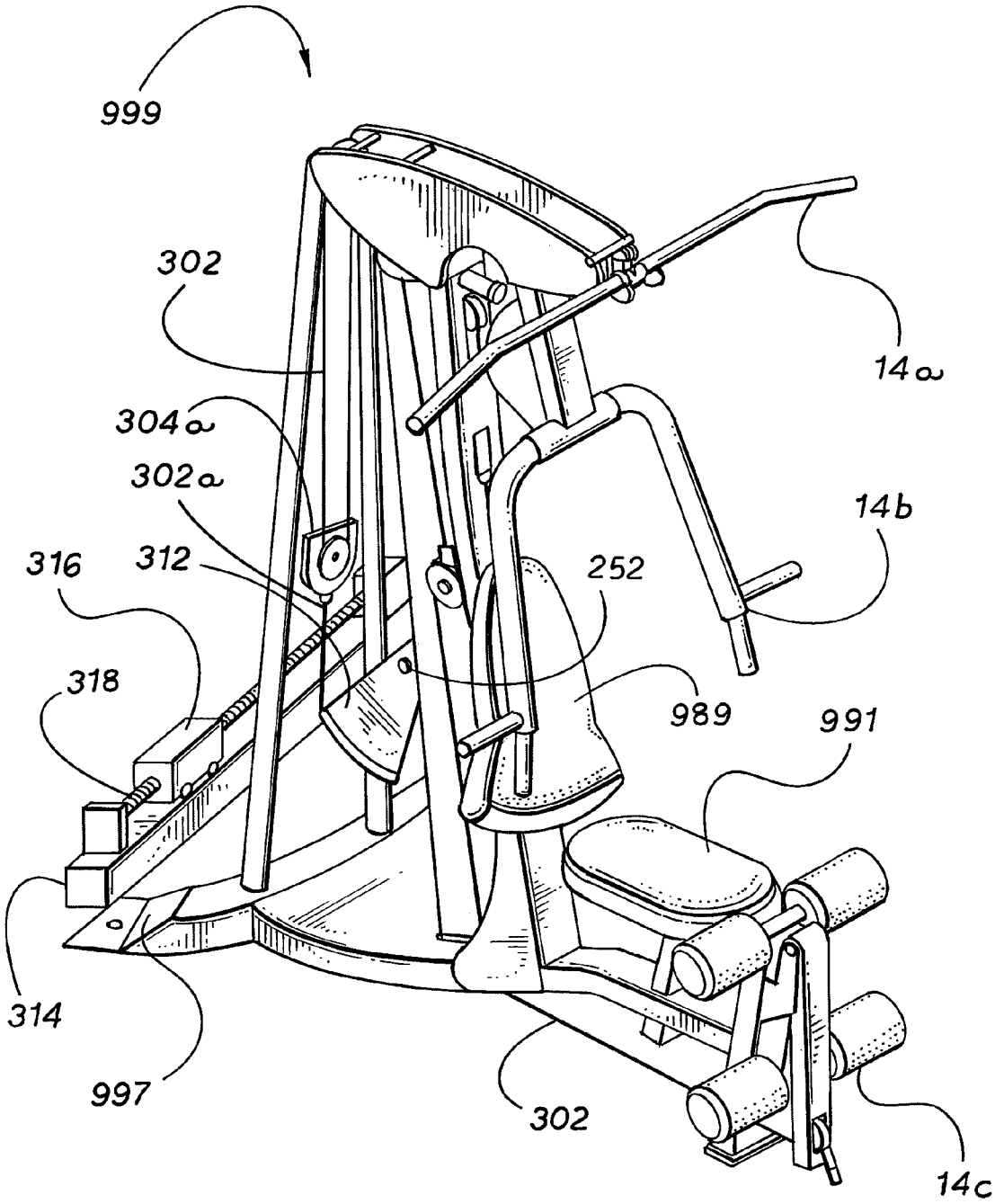
FIG. 8 is a perspective view of a multi-function weight training machine comprising an embodiment of the moment arm weight resistance mechanism of the present invention in the resting mode.
Figure 9:
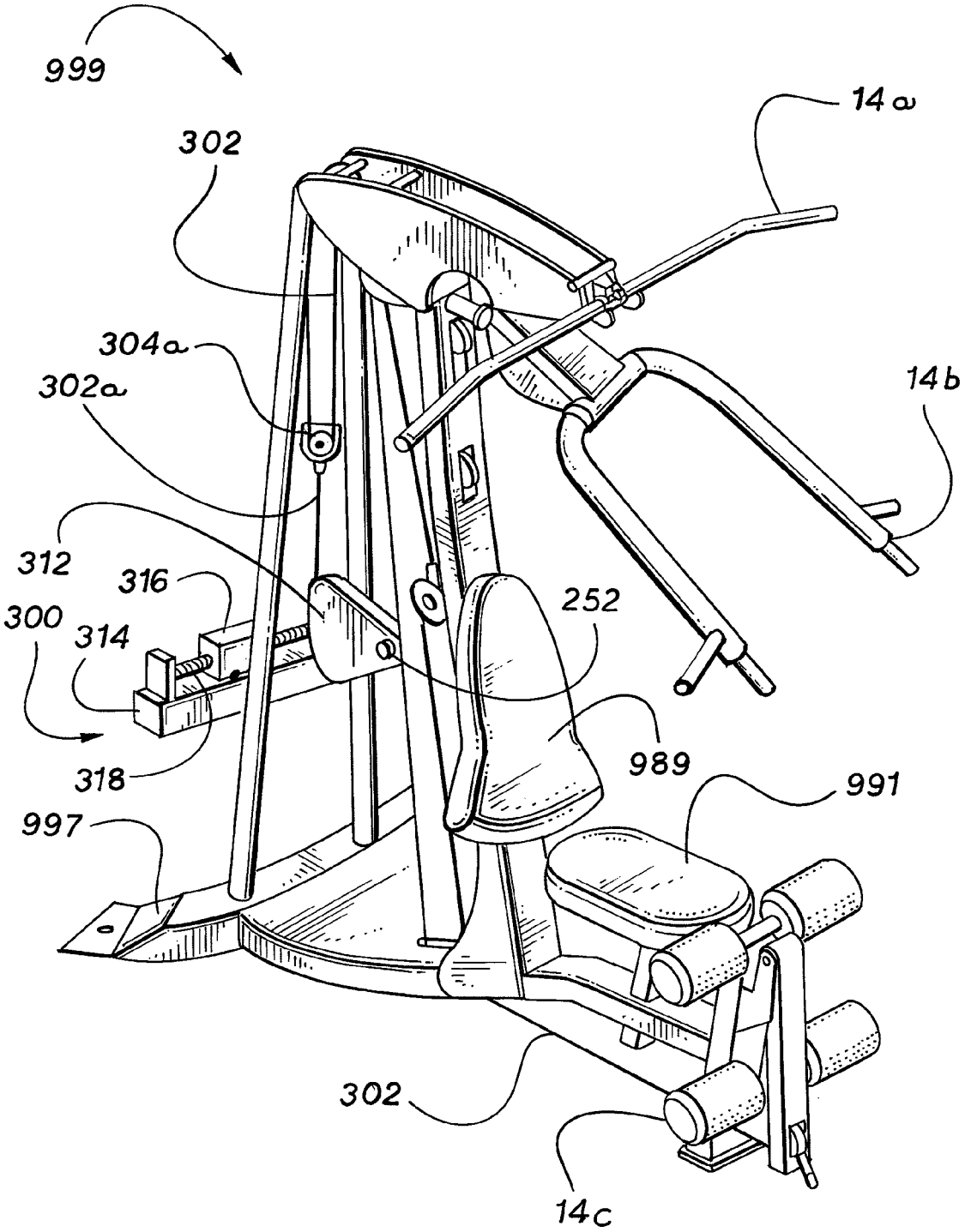
FIG. 9 is a perspective view of the weight training machine shown in FIG. 8 comprising an embodiment of the moment arm weight resistance mechanism of the present invention in the operating mode

FIG. 8 is a perspective view of a third representative weight training machine comprising an embodiment of the moment arm weight resistance mechanism of the present invention in the resting mode, that is, with the user at rest. This weight training machine is a multi-station or multi-function combination weight training machine for exercising all major muscle groups. FIG. 9 is a perspective view of the weight training machine shown in FIG. 8 comprising an embodiment of the moment arm weight resistance mechanism of the present invention in the operating mode, that is with the user lifting weight. FIG. 10 is a side view of an embodiment of a cable and pulley configuration for a combination weight training machine comprising an embodiment of the moment arm weight resistance mechanism of the present invention.

FIG. 11 is a top view of an alternate embodiment of the moment arm weight resistance mechanism of the invention. FIG. 12 is a side view of the alternate embodiment of the moment arm weight resistance mechanism shown in FIG. 11. FIG. 13 is a side view of another alternate embodiment of the moment arm weight resistance mechanism of the invention.

FIG. 1 is a sectional perspective view of a representative embodiment of the moment arm weight resistance mechanism 300 showing basic working elements of the invention. This embodiment of moment arm weight resistance mechanism 300 comprises cam 312, moment arm 314, weight 316, weight adjusting drive 318, pivot point 322, and weight adjusting motor 324. Moment arm 314 is pivotally secured about pivot point 322, about which the moment is created, and extends generally normal to the pivot axis of pivot point 322. Thus, moment arm 314 acts as a cantilever extending from pivot point 322, and moment arm 314 can rotate about the pivot axis of pivot point 322. In this embodiment, moment arm 314 is a generally box-like structure in which weight 316 can roll and can be termed a closed arm embodiment.

FIG. 1 also illustrates that, in this embodiment, moment arm 314 is a generally hollow, elongated, box-like structure containing weight 316 and weight adjusting drive 318. Weight adjusting motor 324 also is shown within moment arm 314, but can be located outside of the box-like structure with weight adjusting drive 318 extending from weight adjusting motor 324 through a hole in an end of, and into the interior of, the box-like structure of moment arm 314. Moment arm 314 is illustratively shown as being welded onto moment arm pivot rod 252 by weldments 344, but moment arm 314 can be secured to moment arm pivot rod 252 by any known or suitable means. Pivot rod 252 is an attachment means for pivotally attaching moment arm 314 to a weight training machine 999. Weight 316 in this example comprises wheels 332 on both its top and bottom surfaces, which can provide for smoother and quieter rolling and less friction between weight 316 and the interior surfaces of moment arm 314. Alternatively, weight 316 can be provided with other devices and means for reducing friction, for quieting operation, and for increasing ease of movement.

FIG. 1 also illustrates an embodiment of cam 312. Generally, cam 312 is secured to moment arm 314 coaxially with the pivot axis of pivot point 322, and the rotation of cam 312 caused by the pulling of cam cable 326, as disclosed in more detail below, causes moment arm 314 to rotate about pivot point 322. The side of cam 312 that cooperates with cam cable 326 can have a groove 362 into which cam cable 326 can lie. Such a groove 362 can help direct and secure cam cable 326 during operation and can help prevent cam cable 326 from slipping off of cam 312.

FIG. 2 is a sectional side view of a weight 316 and weight adjusting drive 318 that can be used with the present invention. Weight 316 comprises a internal passage 352 extending therethrough from one side to an opposite side. In this embodiment, internal passage 352 is a smooth bore with no screw thread. The diameter of internal passage 352 is greater than the outer diameter of the screw thread 354 of weight adjusting drive 318 such that weight adjusting drive 318 can slide into and through internal passage 352. One or more threaded nuts 350 are inserted into internal passage 352 and secured by known means, such as, but not limited to, friction, adhesives, welding, soldering, clips, a flange that is part of the nut 350 itself and screwed into the weight 316, and the like. Weight adjusting drive 318, and particularly the screw thread 354 of weight adjusting drive 318 cooperates with the screw thread 356 of nut 350 such that when weight adjusting drive 318 is rotated, as disclosed herein, weight 316 will move relatively along weight adjusting drive 318.

FIGS. 3, 6 and 9 are views of representative weight training machines 999 focusing in on the operative relationship between the actuating means 14 and the moment arm 314 in what is termed the resting mode. In this mode, the actuating means 14 is in a resting position such that no or a minimal amount of weight or force is being transferred from moment arm 314 and weight 316 to main cable 302 to actuating means 14. Although FIGS. 3, 6, and 9 show an open arm embodiment, this is for illustrative purposes only and to show the relative placement of the various elements of the invention.

FIGS. 4, 7, and 10 are views focusing in on the operative relationship between the actuating means 14 and the moment arm 314 in what is termed the operating mode. In this mode, the actuating means 14 is being moved in an operating manner by a user, thus pulling on the main cable 302. Main cable 302 is pulled through pulleys 304 so as to direct or redirect main cable 302 from actuating means 14 ultimately to moment arm weight resistance mechanism 300. As main cable 302 is pulled, this operates to rotate cam 312. Cam 312 is secured to pivot rod 252 coaxially with the pivot axis of pivot point 322, and the rotation of cam 312 caused by the pulling of main cable 302 or cam cable 326 causes moment arm 314, which also is secured to pivot rod 252, to rotate about pivot point 322. The rotation of moment arm 314 by the rotation of cam 312 causes moment arm 314 to rotate upwards into the operating position. Release of the actuating means 14, has the opposite rotational effect.

In FIGS. 3-9, the configuration of main cable 302 and pulleys 304 from actuating means 14 just prior to weight resistance mechanism 300 can be identical or similar to the configuration of cable and pulleys in known weight training machines, and the specific configuration of main cable 302 and pulleys 304 can be determined by those of ordinary skill in the art without undue experimentation for each type of weight training machine 999, such as those shown in FIGS. 6 and 9.

FIG. 3 is a side view of a first representative weight training machine 999 comprising an embodiment of the moment arm weight resistance mechanism 300 of the present invention in the resting mode, that is, with the user at rest. This weight training machine 999 is a leg extension quadriceps machine. Moment arm weight resistance mechanism 300 is pivotally attached to the back side of weight training machine 999 such that when activated, moment arm 314 can pivot or swing upwards and downwards without any or undue hindrance by any components of weight training machine 999. Pivot rod 252 is pivotally mounted on the frame 997 of weight training machine 999, such as on brackets 995. Brackets 995 can have bearings (not shown) to reduce friction and/or to better hold pivot rod 252. Stop 993 provides a place for moment arm 314 to rest or sit when not in use, and prevents moment arm 314 from traveling downward more than a suitable distance.

FIG. 3 illustrates an exemplary configuration of main cable 302 and pulleys 304 operatively connecting actuating device 14 to moment arm weight resistance mechanism 300. Main cable 302 attaches to actuating device 14, such as by bracket 993, and travels through or about frame 997 via pulleys 304, ultimately to moment arm weight resistance mechanism 300. Main cable 302 can travel through frame 997 for aesthetic and safety purposes. In the embodiment shown, pulley 304A is a class 2 movable pulley attached to a cam cable 302A, which is attached to cam 312. In this weight training machine 999, the moment arm weight resistance mechanism 300 is shown mounted pointed rearward.

FIG. 4 is a side view of the weight training machine 999 shown in FIG. 3 comprising an embodiment of the moment arm weight resistance mechanism 300 of the present invention in the operating mode, that is, with the user lifting weight. The user (not shown) sits on the seat 991 of weight training machine 999 in the known manner, with the user's legs contacting the actuating means 14. Weight training machine 999 also has a backrest 989. When the user actuates (moves, such as by lifting his or her lower legs so as to pivot) the actuating means 14 upwards, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By lifting and lowering actuating means 14, the user causes the upward and downward rotation of moment arm 314, and obtains a weight resistance workout.

FIG. 5 is a rear view of the weight training machine 999 shown in FIG. 3 comprising an embodiment of the moment arm weight resistance mechanism 300 of the present invention. This view better illustrates the structural relationship between moment arm 314, cam 312, pivot rod 252, and brackets 995. As this embodiment uses a class 2 movable pulley 304A, main cable 302 is anchored to frame 997 via anchor 310.

FIG. 6 is a side view of a second representative weight training machine 999 comprising an embodiment of the moment arm weight resistance mechanism 300 of the present invention in the resting mode, that is, with the user at rest. This weight training machine 999 is a latissimus dorsi pull-down machine. Similar to as disclosed in connection with FIG. 3, moment arm weight resistance mechanism 300 is pivotally attached to weight training machine 999 such that when activated, moment arm 314 can pivot or swing upwards and downwards without any or undue hindrance by any components of weight training machine 999. Pivot rod 252 is pivotally mounted on the frame 997 of weight training machine 999. In this weight training machine 999, the moment arm weight resistance mechanism 300 is shown mounted pointed frontward.

FIG. 7 is a side view of the weight training machine 999 shown in FIG. 6 comprising an embodiment of the moment arm weight resistance mechanism 300 of the present invention in the operating mode, that is, with the user lifting weight. Similar to as disclosed in connection with FIG. 4, the user (not shown) sits on the seat 991 of weight training machine 999 in the known manner, with the user gripping the actuating means 14. When the user actuates (moves) on the actuating means 14, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By pulling and releasing actuating means 14, the user causes the upward and downward rotation of moment arm 314, and obtains a weight resistance workout.

FIG. 8 is a perspective view of a third representative weight training machine 999 comprising an embodiment of the moment arm weight resistance mechanism 300 of the present invention in the resting mode, that is, with the user at rest. This weight training machine 999 is a combination multi-station and multi-function combination weight training machine for exercising all major muscle groups. Similar to as disclosed in connection with FIG. 3, moment arm weight resistance mechanism 300 is pivotally attached to weight training machine 999 such that when activated, moment arm 314 can pivot or swing upwards and downwards without any or undue hindrance by any components of weight training machine 999. Pivot rod 252 is pivotally mounted on the frame 997 of weight training machine 999. In this weight training machine 999, the moment arm weight resistance mechanism 300 is shown mounted pointed sideward.

FIG. 9 is a perspective view of the weight training machine shown in FIG. 8 comprising an embodiment of the moment arm weight resistance mechanism of the present invention in the operating mode, that is with the user lifting weight. Similar to as disclosed in connection with FIG. 4, the user (not shown) sits on the seat 991 of weight training machine 999 in the known manner, with the user gripping the actuating means 14A, 14B or with the user's legs contacting the actuating means 14C. Weight training machine 999 also has a backrest 989. When the user actuates (moves) the actuating means 14A, 14B, or when the user lifts his or her legs so as to pivot the actuating means 14C upwards, main cable 302 is pulled with the ultimate result of pulling upwards on cam 312, thus rotating cam 312. When the user pulls down on the actuating means 14, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By pulling and releasing actuating means 14, the user causes the upward and downward rotation of moment arm 314, and obtains a weight resistance workout.

FIG. 10 is a side view of an embodiment of a cable 302 and pulley 304 configuration for a multi-function weight training machine 999 as shown in FIGS. 8 and 9, comprising an embodiment of the moment arm weight resistance mechanism 300 of the present invention. This configuration is known in the industry.

FIG. 11 is a top view of an alternate embodiment of the moment arm weight resistance mechanism 300 of the invention. This embodiment of moment arm weight resistance mechanism 300 comprises cam 312, moment arm 314, weight 316, weight adjusting drive 318, weight adjusting means support 320, pivot point 322, and weight adjusting motor 324. Moment arm 314 is pivotally secured about pivot point 322 and extends generally normal to the pivot axis of pivot point 322. Thus, moment arm 314 acts as a cantilever extending from pivot point 322, and moment arm 314 can rotate about the pivot axis of pivot point 322. In this embodiment, moment arm 314 is a generally flat runway on which weight 316 can roll and can be termed an open arm embodiment.

FIG. 11 illustrates the weight adjusting motor 324 mounted to the side of the moment arm 314, such as on the moment arm pivot rod 252. Weight adjusting drive 318 is a cable, wire, chain, belt, or other flexible material extending around pulleys 320A, which act as the de facto weight adjusting drive supports. Weight 316 is attached to the wire of weight adjusting drive 318. Weight adjusting motor 324 turns one of the pulleys 320A, which causes the movement of the weight adjusting drive 318 about the pulleys 320A, thus moving the weight 316 along or relative to the moment arm 314 in either direction.

FIG. 12 is a side view of the alternate embodiment of the moment arm weight resistance mechanism 300 shown in FIG. 11.

FIG. 13 is a side view of another alternate embodiment of the moment arm mechanism 300 of the invention. This embodiment has the weight adjusting motor 324 located within a cart 334, and with weight 316 attached to the cart 334. Weight adjusting drive 318 again is a screw, but this time journaled between two weight adjusting drive supports 320 located on opposite ends of the moment arm 314. Weight adjusting motor 324 cooperates directly with weigh adjusting drive, such that when weight adjusting motor 324 is actuated, a threaded passage within weight adjusting motor 324 cooperates with the external screw thread of weight adjusting drive 318, and weight adjusting motor 324 moves along weight adjusting drive 318. Being in a cart 334 with wheels 332 allows weight adjusting motor 324 and attached weight 316 to move along or relative to moment arm 314.

Although moment arm 314 is shown on the back of the weight training machine 999 and extending either backward, frontward, or from side to side in several of the illustrative examples, the location of moment arm weight resistance mechanism 300 can be changed depending on the desired footprint, function, and/or aesthetics of the weight training machine 999 with relocation of the various operating components, such as cable 302 and pulleys 304.

In the closed arm embodiment illustrated in FIG. 1, moment arm weight resistance mechanism 300 illustratively comprises cam 312, moment arm 314, weight 316, weight adjusting drive 318, pivot point 322 (corresponding to the end of the moment arm pivot rod 252), and weight adjusting motor 324. In this embodiment, moment arm 314 can be an elongated hollow box-like structure containing weight 316, weight adjusting drive 318, and weight adjusting motor 324. This embodiment is more self-contained than the open arm embodiment disclosed herein and can help prevent outside interference with the movement of weight 316 and the operation of weight adjusting drive 318 and weight adjusting motor 324.

In the closed arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative examples shown, weight adjusting drive 318 is a linear screw attached at one end to weight adjusting motor 324 and is free-floating at another end. Weight adjusting motor 324, in this example, turns weight adjusting device 318, which in turn cooperates with a complimentary internal threaded passage or a combination of an internal passage 352 and threaded nut 350, on weight 316 so as to move weight 316 back and forth along moment arm 314. Weight adjusting drive 318 is located generally parallel with and slightly offset from moment arm 314.

In the open arm embodiment illustrated in FIG. 3, moment arm weight resistance mechanism 300 illustratively comprises cam 312, moment arm 314, weight 316, weight adjusting drive 318, weight adjusting means support 320, pivot point 322 (corresponding to the axis of the moment arm pivot rod 252), and weight adjusting motor 324. In this embodiment, moment arm 314 can be a rod, hollow or solid, having a rectangular cross-section, or at least a flat upper surface 328. Alternatively, moment arm 314 can have an I-beam structure, be a flat planar structure, or any equivalent structure that can support weight 316, allow the operative attachment of weight adjusting drive 318 to weight 316, and provide for attachment to moment arm pivot rod 252.

In the open arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative example shown, weight adjusting drive 318 is a linear screw attached at one end to weight adjusting motor 324 and attached at another end to weight adjusting drive support 320. Specifically, weight adjusting drive support 320 is journaled into weight adjusting drive support 320 via a bearing, a low friction device, or the equivalent. Weight adjusting motor 324, in this example, turns weight adjusting device 318, which in turn cooperates with a complimentary internal threaded passage on weight 316 or a combination of an internal passage 352 and threaded nut 350, so as to move weight 316 back and forth along moment arm 314. Weight adjusting drive 318 is located generally parallel with and slightly offset from moment arm 314.

Weight adjusting motor 324 can be a bidirectional electric motor secured on the upper surface of moment arm 314. Preferably, weight adjusting motor 324 is located proximal to the pivot point 322 as weight adjusting motor 324 does have some weight and, if located on the free end 330 of moment arm 314, would impart a certain amount of weight to moment arm 314 creating an increased base moment about pivot point 322. Weight adjusting motor 324 can be selected to move weight 316 relative to or along moment arm 314 away from or towards pivot point 322, and therefore must be of sufficient power to accomplish this task. Alternatively, weight adjusting motor 324 can be mounted outside of moment arm 314 and a hole can be located on the end of moment arm 314 to allow weight adjusting drive to extend therethrough and into the interior of moment arm 314 to cooperate with weight 316.

Weight 316 can be any structure having mass. In the illustrative example shown, weight 316 is a solid mass having an internal threaded passage extending from a first side to an opposite second side or a combination of an internal passage 352 and threaded nut 350. Internal threaded passage or nut 350 cooperates with the screw thread on weight adjusting drive such that when weight adjusting drive is turned or rotated by weight adjusting motor 324, weight 316 is forced to move linearly. Weight 316 can comprise optional wheels 332 on the bottom and optionally on the top that cooperate with moment arm 314 to allow the easier movement of weight 316 along moment arm 314. Thus, as weight adjusting motor 324 turns weight adjusting drive 318, the complimentary screw threads cooperate and force weight 316 to move linearly along or relative to moment arm 314.

Weight 316 causes a moment about pivot point 322, thus urging a rotation of moment arm pivot rod 252 about its axis. As moment arm pivot rod 252 is rotationally urged, cam 312 also is rotationally urged in the same direction, thus acting on cam cable 326 by pulling main cable 302 downward or at least imparting a downward tensional force on main cable 302. The tensional force on main cable 302 is imparted to actuating means 14, which imparts a pulling force or weight resistance on the user grasping the actuating means 14.

The amount or level of pulling force or weight resistance can be adjusted by moving the weight 316 along the moment arm 314. If the weight 316 is proximal to the pivot point 322, then the moment created by the weight 316 is minimal and therefore the amount or level of pulling force or weight resistance imparted to the user is minimized. If the weight 316 is distal to the pivot point, then the moment created by the weight 316 is maximized and therefore the amount or level of pulling force or weight resistance imparted to the user is maximized. Conventional controls operate the weight adjusting motor 324 so as to move the weight 316 to the desired position along the moment arm 314 for imparting the desired amount or level of pulling force or weight resistance to the user as the user pulls on the actuating means 14. Alternatively, weight 316 can be moved manually by the user.

Main cable 302 and cam cable 326 can be of any structure, such as a rope, a chain, a belt, monofilaments, braided wires, flexible materials, and other suitable equivalents, that allow a transfer of force between actuating means 14 and moment arm weight resistance mechanism 300, and is not limited to a standard cable. As disclosed herein, main cable 302 can be directed around one or more pulleys 304 to direct or redirect main cable 302 between the actuating means 14 and the moment arm weight resistance mechanism 300, and to prevent main cable 302 from becoming entangled in the internal mechanical components of weight training machine 999. Thus, in operation, when user pulls or moves actuating means 14, this force transfers to main cable 302, which in turn acts on moment arm weight resistance means 300 by lifting moment arm 314, thus creating the moment due to the weight of the weight 316 (and the moment arm itself, as well as any components on or attached to the moment arm 314).

Pulleys 304 can be fixed class 1 pulleys that are mounted on a frame of the weight training machine 999 to direct and redirect the force of main cable 302 and do not move, except to rotate as main cable 302 moves over them. Alternatively, one or more of pulleys 304 can be a movable class 2 pulley to transform the force of main cable 302 to cam 312. Although all pulleys 304 can be fixed pulleys or movable pulleys, or a combination of fixed and movable pulleys, depending on the relative force needed to operate the moment arm weight resistance mechanism 300, the combination of fixed and movable pulleys provides a suitable transformation of the user's U energy to the actuation of the moment arm weight resistance mechanism 300.

The degree of weight resistance can be controlled by user. At settings in which weight 316 is creating a moment on moment arm 314 about pivot point 322, user would be subject to weight resistance and the exercise regimen would be similar to conventional electronic, stack or free weight exercise machines, for example. The higher the setting of the moment arm weight resistance means 300 (that is, with weight 316 further from pivot point 322), the heavier the weight resistance. With this arrangement, it is therefore possible to vary the weight resistance during the exercise regimen.

A comparison of the position of actuating means 14 shows how actuating means 14 can move. Actuating means 14 is shown in the at rest position in FIGS. 3, 6, and 9, and in the operational position (partially extended) in FIGS. 4, 7, and 10. Actuating means 14 can move between the at rest position and a fully extended position, and the position of actuating means 14 during operation is dependent on user. Optional stops (not shown) can prevent actuating means 14 from moving past the at rest position in one direction of motion and the fully extended position in the opposite direction of motion.

Various other features and elements can be included in the weight training machine 999 to compliment the moment arm weight resistance mechanism 300. For example, the moment arm weight resistance mechanism 300 can be enclosed in a structure attached to or supported by frame 997 for aesthetic and safety purposes. A second stop can be attached to frame 997 to stop the upward motion of the moment arm 314 so as to prevent over extension. Locks or stops, adjustable or otherwise, also can be added to lock the moment arm in the resting position or at any desired operating position or to limit the range of motion.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A weight training machine comprising a frame and a moment arm weight resistance means, the moment arm weight resistance means comprising:

a) a cantilevered moment arm pivotally attached to the frame at a pivot point;

b) an adjustable weight attached to the moment arm;

c) a weight adjusting drive for adjusting the adjustable weight along the moment arm; and d) an actuating means operatively connected to the moment arm weight resistance means at the pivot point, wherein moving the actuating means actuates the moment arm weight resistance means, wherein movement of the adjustable weight along the moment arm creates a moment about the pivot point, wherein the degree of weight resistance can be controlled by a user, wherein the moment arm weight resistance means is variable for providing varying weight resistance and can be varied by a user during an exercise regimen, and wherein the adjustable weight and the weight adjusting drive are supported on the moment arm and the weight adjusting drive is operatively attached to the adjustable weight.

2. The weight training machine as claimed in claim 1, wherein the actuating means is movable between a first at rest position and a second fully extended position and can be maintained at any position between the first at rest position and the second fully extended position.

3. The weight training machine as claimed in claim 1, wherein the weight adjusting drive is selected from the group consisting of motors, pneumatic cylinders, hydraulic cylinders, and force generating devices.

4. The weight training machine as claimed in claim 1, wherein at least a portion of the moment arm weight resistance means is pivotable about the pivot point.

* * * * *